US007740135B2

(12) United States Patent
Taylor

(10) Patent No.: US 7,740,135 B2
(45) Date of Patent: Jun. 22, 2010

(54) ARTICLE OF MANUFACTURE FOR CARRYING AND STORING GOLF CLUBS AND RELATED ACCESSORIES REQUIRED TO PLAY GOLF

(75) Inventor: Frank Everett Taylor, Dallas, TX (US)

(73) Assignee: Frank E. Taylor, Dallas, TX (US)

( * ) Notice: Subject to any disclaimer, the term of this patent is extended or adjusted under 35 U.S.C. 154(b) by 882 days.

(21) Appl. No.: 11/592,583

(22) Filed: Nov. 3, 2006

(65) Prior Publication Data

US 2008/0105575 A1 May 8, 2008

(51) Int. Cl.
*A63B 55/00* (2006.01)

(52) U.S. Cl. ..... 206/315.3; 206/315.6; 206/315.4; 206/315.7; 206/315.8; 206/315.1

(58) Field of Classification Search ... 206/315.1–315.7; 224/245, 264, 247, 581, 618, 678, 679
See application file for complete search history.

(56) References Cited

U.S. PATENT DOCUMENTS

| | | | | | |
|---|---|---|---|---|---|
| 2,070,254 | A | * | 2/1937 | Burgner | 211/70.2 |
| 2,105,853 | A | * | 1/1938 | Brodie | 206/315.6 |
| 2,791,255 | A | * | 5/1957 | Ogden | 294/143 |
| 3,164,185 | A | * | 1/1965 | Ingoldt | 294/159 |
| 3,315,815 | A | * | 4/1967 | Wittek | 211/70.2 |
| 4,138,139 | A | * | 2/1979 | Alfonso | 280/652 |
| 4,726,597 | A | | 2/1988 | Hickin | |
| 4,792,152 | A | | 12/1988 | Carolan | |
| 4,860,889 | A | | 8/1989 | Lemieux et al. | |
| 4,890,856 | A | | 1/1990 | Mursch et al. | |
| 4,911,465 | A | | 3/1990 | Hauer | |
| 5,112,068 | A | | 5/1992 | Liao et al. | |
| 5,263,602 | A | * | 11/1993 | Lathouris | 220/23.83 |
| 5,833,250 | A | * | 11/1998 | Schier et al. | 280/47.19 |
| 6,056,301 | A | | 5/2000 | Berliner et al. | |
| D427,431 | S | * | 7/2000 | Jensen | D3/255 |
| D429,071 | S | * | 8/2000 | Hurt | D3/315 |
| 6,202,840 | B1 | * | 3/2001 | Chang | 206/315.4 |
| 6,269,947 | B1 | * | 8/2001 | Chang | 206/315.6 |
| 6,460,867 | B2 | | 9/2002 | Sciulli | |
| 6,604,473 | B2 | * | 8/2003 | Felsenthal | 108/107 |
| 7,114,730 | B2 | | 10/2006 | Cheldin | |

* cited by examiner

*Primary Examiner*—Anthony Stashick
*Assistant Examiner*—Cynthia F Collado
(74) *Attorney, Agent, or Firm*—Scott Richardson

(57) ABSTRACT

An article of manufacture for transporting, using and storing golf clubs and related accessories required to play golf, with: a) a base that provides fifteen individual compartments lined with material to protect club heads; connected to b) a three-tiered top with rubberized slots for individual club shaft containment; with c) individual flexible material bags attached to each top tier providing storage; with d) the ability to be attached to a standard two person motorized golf cart; with e) attachable wheels and an attachable handle that converts the carrier to a pull cart; with f) front and back rings available to attach a shoulder strap for carrying. This new concept of having the golf clubs outside the storage compartments provides increased storage, while providing orderly club storage and protection for each club head and shaft.

1 Claim, 3 Drawing Sheets

ARTICLE OF MANUFACTURE FOR CARRYING AND STORING GOLF CLUBS AND RELATED ACCESSORIES REQUIRED TO PLAY GOLF

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of golf club carriers and more specifically to an article of manufacture for carrying and storing golf clubs and related accessories required to play golf.

As golf clubs increase in value, there is a need for better club protection. Along with club protection there is a demand for more orderly storage of clubs for convenient and faster play. There has been no easy, low cost way to determine if a club is missing while playing. Golfers generally use a motorized golf carts, but at times may walk and shoulder carry or pull a bag on a pull cart. Increased storage area is desirable for those times when additional items are to be carried with the golfer.

There is nothing available that offers all of these features in one unit. Storing each club head in an upright manner in an individually protected compartment, while having a rubberized slot to securely and conveniently protect and store each club shaft offers new and innovative features. On occasion a golfer will hand carry several clubs to advance the ball and accidentally leave one on the golf course. With this club storage and carrier system, a missing club will quickly be noticed.

By increasing the storage area, insulated compartments for beverages will be added. Storage compartments may have transparent material showing the golfer a view of the contents of each compartment.

It is an object of this current invention to provide an innovative alternative to conventional methods of transporting, storing and protecting golf clubs and golf accessories, while offering flexible usage and features not currently available.

Carriers of golf clubs with dividers, handles and wheels are known in the prior art such as U.S. Pat. Nos. 7,114,730; 6,460,867; 6,056,301; 5,112,068; 4,911,465; 4,890,856; 4,860,889; 4,792,152 and 4,726,597. However, none of these patents offer the specific combination of features of the present invention.

Prior technology does not provide a golf club carrier that stores each club independently, outside the storage compartments, with club heads down, eliminating the need for club head covers while providing protection for each golf club against damage. Current systems used on motorized golf carts do not enable the user to quickly notice a missing club. Standard storage compartments currently available on golf bags are not sufficient to provide additional space for storage of cold beverages as well as having transparent material allowing the user to view compartment contents.

BRIEF SUMMARY OF THE INVENTION

The primary object of the invention is to provide a golf club carrier that securely stores and protects each club independently.

Another object of the invention is to provide a golf club carrier that eliminates the need for protective club head covers.

A further object of the invention is to provide a golf club carrier that can be used on a standard motorized golf cart; as a self contained pull cart or be shoulder carried.

Yet another object of the invention is to provide more than double the cubic inches of storage capacity of a standard golf bag.

Still yet another object of the invention is to enable the user to quickly notice a missing club.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an article of manufacture for transporting, using and storing golf clubs and related accessories required to play golf, comprising: A rectangular base with a convex front that provides fifteen individual adjacent compartments of various sizes for golf club heads, said base compartments are lined with material for club head protection. A rectangular three tiered (bottom, middle and upper) top with convex front, that has rubberized slots for convenient and secure individual club shaft containment, said top and base connected by side, front and back vertical supports. Fifteen slots on the top are identified for a specific golf club based on its shaft length and club head size, and provides external storage for golf balls and tees. Individual flexible material bags attached to each said top tier provides storage for golf wear and related supplies. Attachable wheels and an attachable handle converts the carrier to a pull cart. Front and back rings available to attach a shoulder strap for carrying. Strap on the said back vertical support that securely attaches the carried to a standard two person motorized golf cart, and straps external to said front and side vertical supports to secure additional items, such as: umbrella, ball retriever, etc.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
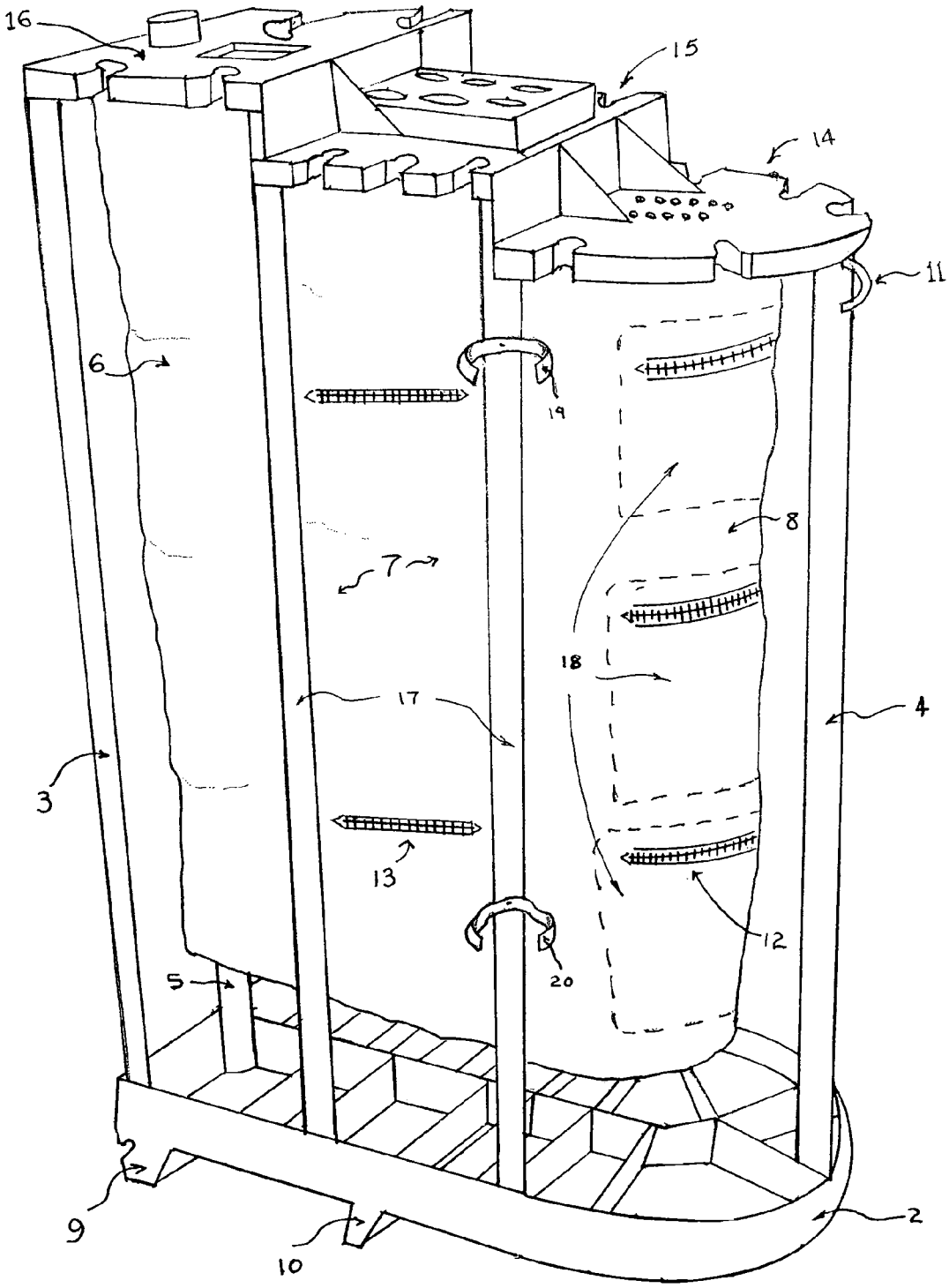
FIG. 1 is a perspective view of the invention.
Figure 3:
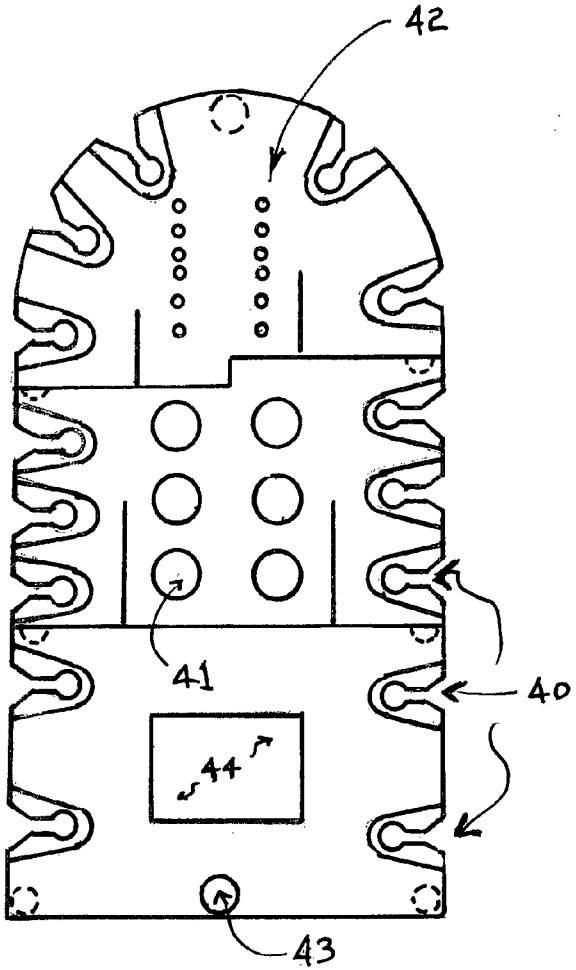
FIG. 3 is a plan view of the top of the invention.
Figure 2:
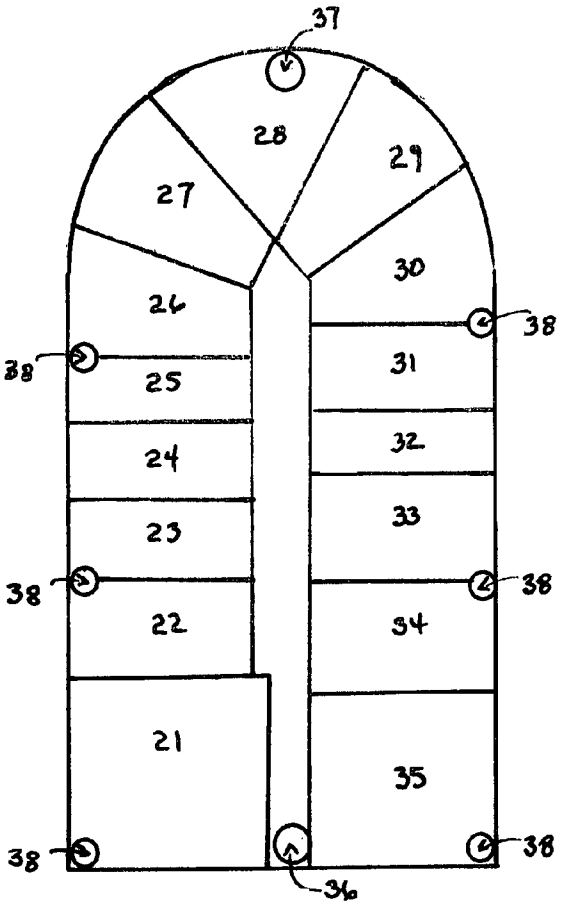
FIG. 2 is a plan view of the base of the invention.
Figure 5:
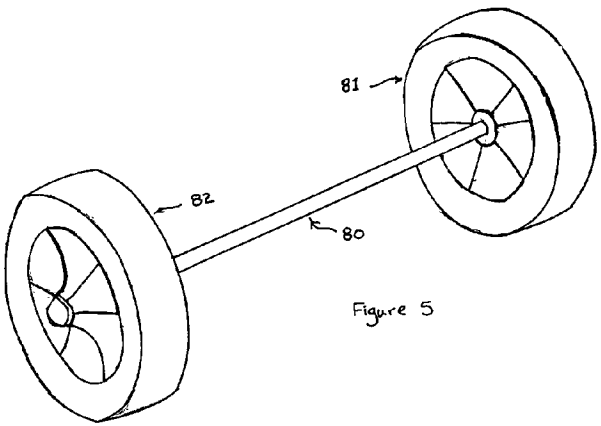
FIG. 5 is a perspective view of the attachable wheels of the invention.
Figure 6:
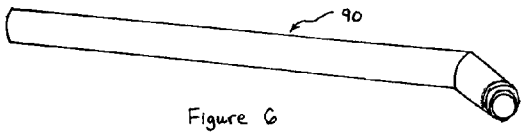
FIG. 6 is a perspective view of the attachable handle of the invention.
Figure 4:
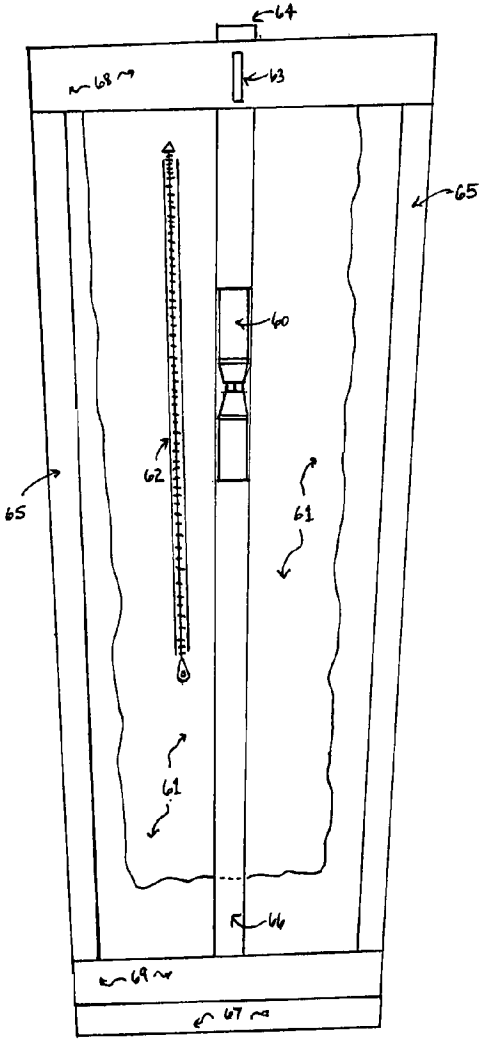
FIG. 4 is a plan view of the back of the invention.

In accordance with the present invention, FIG. 1 shows the embodiment of this new, convenient, secure method of transporting, using and storing golf clubs. This new concept is comprised of a molded base 2, 69 with two short legs 9, 10. The base 2 rear leg 9, 67 has a notch for the quick attachment of the wheel's 81, 82 axle 80 when using as a pull cart. There are fifteen individual compartments 21 thru 35 in the base 2 lined with a protective material for each golf club head. The base is connected to the molded three-tiered top 14, 15 and 16 by multiple vertical supports: side supports 17, 38, 65; front support 4, 37 and a rear support 5, 36, 66.

The molded three-tier top 14, 15,16 has fifteen rubberized notches 40 to securely store each golf club shaft. The top middle tier 15 has external storage 41 for golf balls. The top bottom tier 14 has storage for golf tees 42. The upper top tier 16 has external storage 44 for portable GPS device.

Three bags 6,7,8 made from flexible material are suspended from the three-tiered top 14,15,16. Each bag has from one to multiple compartments for accessory storage with secured openings 12, 13, 62. Bag compartments may have transparent covering 18 to enable the user to view compartment contents. Compartments may also be insulated for cold beverage storage.

Attached to the rear vertical support 66 is a strap 60 that enables the user to attach this invention to a standard two person motorized golf cart.

Sturdy rings 11, 63 on the front vertical support 4 and on the rear vertical support 66 allow the user to attach a shoulder strap for carrying.

On the top upper-tier 16, the user can attach a removable handle 90 to the top upper tier 64 when using as a pull cart.

Straps 19,20 on the front side support 17 to be used to attach additional items such as: umbrella, golf ball retriever, etc.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture for transporting, using and storing golf clubs and related accessories required to play golf, the article comprising:

a rectangular base with a convex front that provides at least fifteen individual adjacent compartments, wherein each of said compartments are sized to receive a golf club head, and wherein each of said compartments are lined with material for club head protection;

a rectangular tiered top having a bottom tier, a middle tier, an upper tier, external storage for golf balls and tees, and a convex front, the tiered top including a plurality of rubberized slots, each slot configured for releasable individual club shaft containment, wherein the at least fifteen slots are identified for a specific golf club based on the shaft length and club head size of the golf club;

said top and base connected by side, front and back vertical supports;

a plurality of flexible material bags attached to each tier of said tiered top, the bags capable of providing storage for golf wear and related supplies;

attachable wheels and an attachable handle operable to convert the article to a pull cart;

front and back rings operable to receive a shoulder strap for carrying;

at least one strap coupled to said side vertical support to secure additional golf accessories thereto;

insulated cold beverage storage in at least one of said bags;

wherein at least one bag includes multiple compartments with transparent material allowing a user to view the contents of each compartment;

wherein the article is capable of being selectively stored in at least one of an upright position and a horizontal position, allowing transporting in a vehicle while protecting each club;

wherein at least one of said bags on said tiered top allows golf shoe storage; and a strap on the said back vertical support and two legs on the bottom of said base, said strap and legs configured to securely attach the article to a standard two person motorized golf cart.

* * * * *